US010894281B2

(12) United States Patent
Boehnlein et al.

(10) Patent No.: US 10,894,281 B2
(45) Date of Patent: Jan. 19, 2021

(54) TUBE BENDING APPARATUS AND METHOD

(71) Applicant: Stride Tool, LLC, Glenwillow, OH (US)

(72) Inventors: Lynne Boehnlein, Glenwillow, OH (US); Leonard R. Murg, Eastlake, OH (US); Ryan Jarvis, Glenwillow, OH (US)

(73) Assignee: STRIDE TOOL, LLC., Glenwillow, OH (US)

( * ) Notice: Subject to any disclaimer, the term of this patent is extended or adjusted under 35 U.S.C. 154(b) by 278 days.

(21) Appl. No.: 16/028,827

(22) Filed: Jul. 6, 2018

(65) Prior Publication Data

US 2019/0015886 A1 Jan. 17, 2019

Related U.S. Application Data

(60) Provisional application No. 62/530,916, filed on Jul. 11, 2017.

(51) Int. Cl.

| | |
|---|---|
| ***B21D 7/024*** | (2006.01) |
| ***B21D 9/04*** | (2006.01) |
| ***B21D 7/06*** | (2006.01) |

(52) U.S. Cl.

CPC ..... *B21D 7/024* (2013.01); *B21D 7/06* (2013.01); *B21D 7/063* (2013.01); *B21D 9/04* (2013.01)

(58) Field of Classification Search

CPC ..... B21D 7/024; B21D 7/022; B21D 7/02; B21D 7/04; B21D 7/00; B21D 7/06;

(Continued)

(56) References Cited

U.S. PATENT DOCUMENTS 1,247,729 A * 11/1917 Scribner ..... B21D 7/063 72/459

1,576,984 A 3/1926 McLain (Continued)

FOREIGN PATENT DOCUMENTS

DE 2715178 A1 * 10/1977 ..... B21D 7/063

GB 902745 A * 8/1962

(Continued)

*Primary Examiner* — Teresa M Ekiert

*Assistant Examiner* — Sarkis A Aktavoukian

(74) *Attorney, Agent, or Firm* — Tarolli, Sundheim, Covell & Tummino LLP

(57) ABSTRACT

A bending wheel of a tube bending apparatus includes a tube-accepting recess, proximal and distal wheel faces, and a rotation recess. The proximal wheel face includes a lever pivot anchor. A cam insert includes a shaft having a tool driving feature. The shaft is configured for selective insertion into the rotation recess. The cam insert includes a camming flange, which includes a lever urging feature. A keeper lever includes a keeper finger rigidly connected to a laterally extending lever arm and extending longitudinally from the proximal wheel face. An anchor end of the lever arm includes an arm pivot feature and a spaced-apart cam following feature configured to interact with the lever urging feature. Rotation of the cam insert causes rotation of the lever urging feature to drive the cam following feature of the keeper lever and pivot the lever arm in the same rotational direction.

20 Claims, 17 Drawing Sheets

(58) Field of Classification Search
CPC ..... B21D 7/063; B21D 7/066; B21D 9/073; B21D 9/07; B21D 9/04; B21D 9/00; B21D 9/05; B21D 9/076; B21D 9/08; B21D 9/085
See application file for complete search history.

(56) References Cited

U.S. PATENT DOCUMENTS

| | | | | |
|---|---|---|---|---|
| 2,709,382 | A | 5/1955 | Safranski | |
| 2017/0197238 | A1 * | 7/2017 | Lauer | B21D 11/10 |

FOREIGN PATENT DOCUMENTS

| | | | | |
|---|---|---|---|---|
| WO | WO-2008052538 | A2 * | 5/2008 | B21D 7/02 |
| WO | 2008/086787 | A2 | 7/2008 | |

* cited by examiner

TUBE BENDING APPARATUS AND METHOD

RELATED APPLICATION

This application claims priority from U.S. Provisional Application No. 62/530,916, filed 11 Jul. 2017, the subject matter of which is incorporated herein by reference in its entirety.

TECHNICAL FIELD

This disclosure relates to an apparatus and method for use of a tube bender.

BACKGROUND

When a user is running relatively small-diameter (e.g., quarter-inch or smaller OD, such as, but not limited to, ⅛", 3⁄16", and ¼") tubing along a tortuous or labyrinthine path—such as running a brake line in a vehicle assembly use environment or running a gas line in a building construction use environment—the tubing normally is pre-bent to fit along a pre-planned route (e.g., within a channel in a vehicle frame). However, the user often finds that the pre-bent tubing does not fit the intended route as precisely as is desired. Accordingly, the user often "tweaks" or slightly adjusts the existing bends, or add new bends as needed (particularly when the route is being determined real-time) to make the tubing better fit the desired routing. Such hand-bending, however, often is done with pliers that can damage the tubing surface, and/or results in kinks or abrupt angles in the tubing structure that can have a negative effect on fluid flow through the tube. In addition, there is often very little clearance at the desired bend site for a hand tool to be used.

Commercially available tube benders are often used to bend tubing for routing along a desired path. Those known tube benders are generally too large, though, to accept the relatively small-diameter tubing in many use environments. Additionally, the known tube benders use relatively long handles to provide the "lever arm" forces to bend the tube as needed. Therefore, even if the known tube benders were to be resized for use with smaller-diameter tubing, there could still be clearance/interference issues in tight quarters at the bend site, due to the "lever arm" handles used in the existing tube bending devices.

SUMMARY

In an aspect, a tube bending apparatus is disclosed. A bending wheel includes a circumferential tube-accepting recess and oppositely facing proximal and distal wheel faces. The bending wheel includes a rotation recess extending longitudinally through the bending wheel between the proximal and distal wheel faces along a central axis of the bending wheel. The proximal wheel face includes a lever pivot anchor. A cam insert includes a longitudinally extending shaft having a tool driving feature extending coaxially at least partially therethrough. The shaft is configured for selective insertion into the rotation recess. The cam insert includes a camming flange extending laterally from at least a portion of a proximal face of the shaft. The camming flange includes a lever urging feature spaced laterally apart from the tool driving feature. A keeper lever includes a longitudinally extending keeper finger rigidly connected to an outboard end of a laterally extending lever arm and extending longitudinally from the proximal wheel face to at least a proximal-most portion of the tube-accepting recess. An anchor end of the lever arm includes an arm pivot feature, configured to pivotally connect to the lever pivot anchor. The lever arm includes a cam following feature spaced apart from the arm pivot feature. The cam following feature is configured to interact with the lever urging feature of the camming flange. The shaft is selectively located at least partially within the rotation recess to bring the camming flange in proximity to the proximal wheel face. The arm pivot feature of the keeper lever is concurrently pivotally connected to the lever pivot anchor. The cam following feature of the keeper lever is operatively connected to the lever urging feature. Rotation of the cam insert in a selected rotational direction causes rotation of the lever urging feature in that rotational direction, which responsively drives the cam following feature of the keeper lever to pivot the lever arm in the same rotational direction about the lever pivot anchor.

In an aspect, a method of bending a tube is disclosed. A tube bending apparatus is provided, including a bending wheel including a circumferential tube-accepting recess and oppositely facing proximal and distal wheel faces. The bending wheel includes a rotation recess extending longitudinally through the bending wheel between the proximal and distal wheel faces along a central axis of the bending wheel. The proximal wheel face includes a lever pivot anchor. A cam insert includes a longitudinally extending shaft having a tool driving feature extending coaxially at least partially therethrough. The shaft is configured for selective insertion into the rotation recess. The cam insert includes a camming flange extending laterally from at least a portion of a proximal face of the shaft. The camming flange includes a lever urging feature spaced laterally apart from the tool driving feature. A keeper lever includes a longitudinally extending keeper finger rigidly connected to an outboard end of a laterally extending lever arm and extending longitudinally from the proximal wheel face to at least a proximal-most portion of the tube-accepting recess. An anchor end of the lever arm includes an arm pivot feature, configured to pivotally connect to the lever pivot anchor. The lever arm includes a cam following feature spaced apart from the arm pivot feature. The cam following feature is configured to interact with the lever urging feature of the camming flange. The shaft is located at least partially within the rotation recess to bring the camming flange in proximity to the proximal wheel face. Concurrently, the arm pivot feature of the keeper lever is pivotably connected to the lever pivot anchor. The cam following feature of the keeper lever is operatively connected to the lever urging feature. The tube is placed at least partially in the tube-accepting recess with a bending target portion of the tube, spaced apart from at least one end of the tube, in a tangent relationship to the bending wheel. Rotation of the cam insert is driven in a selected rotational direction to cause rotation of the lever urging feature in that rotational direction. With the lever urging feature, the cam following feature of the keeper lever is responsively driven to pivot the lever arm in the selected rotational direction about the lever pivot anchor. The keeper finger is brought proximate the tube-accepting recess through pivoting of the lever arm in the selected rotational direction about the lever pivot anchor. A spatial position of the at least one end of the tube is maintained with respect to the tube bending apparatus. The tube bending apparatus is rotated in the selected rotational direction with the keeper finger held proximate the tube-accepting recess. With the keeper finger, egress of the tube from the tube-accepting recess is prevented. The tube is at least partially wrapped around the bending wheel to bend the tube due to the combination of the differently-directed forces applied to the tube by the keeper finger and the maintained spatial position of the at least one end of the tube.

BRIEF DESCRIPTION OF THE DRAWINGS

For a better understanding, reference may be made to the accompanying drawings, in which.

DESCRIPTION OF ASPECTS OF THE DISCLOSURE

Figure 1:
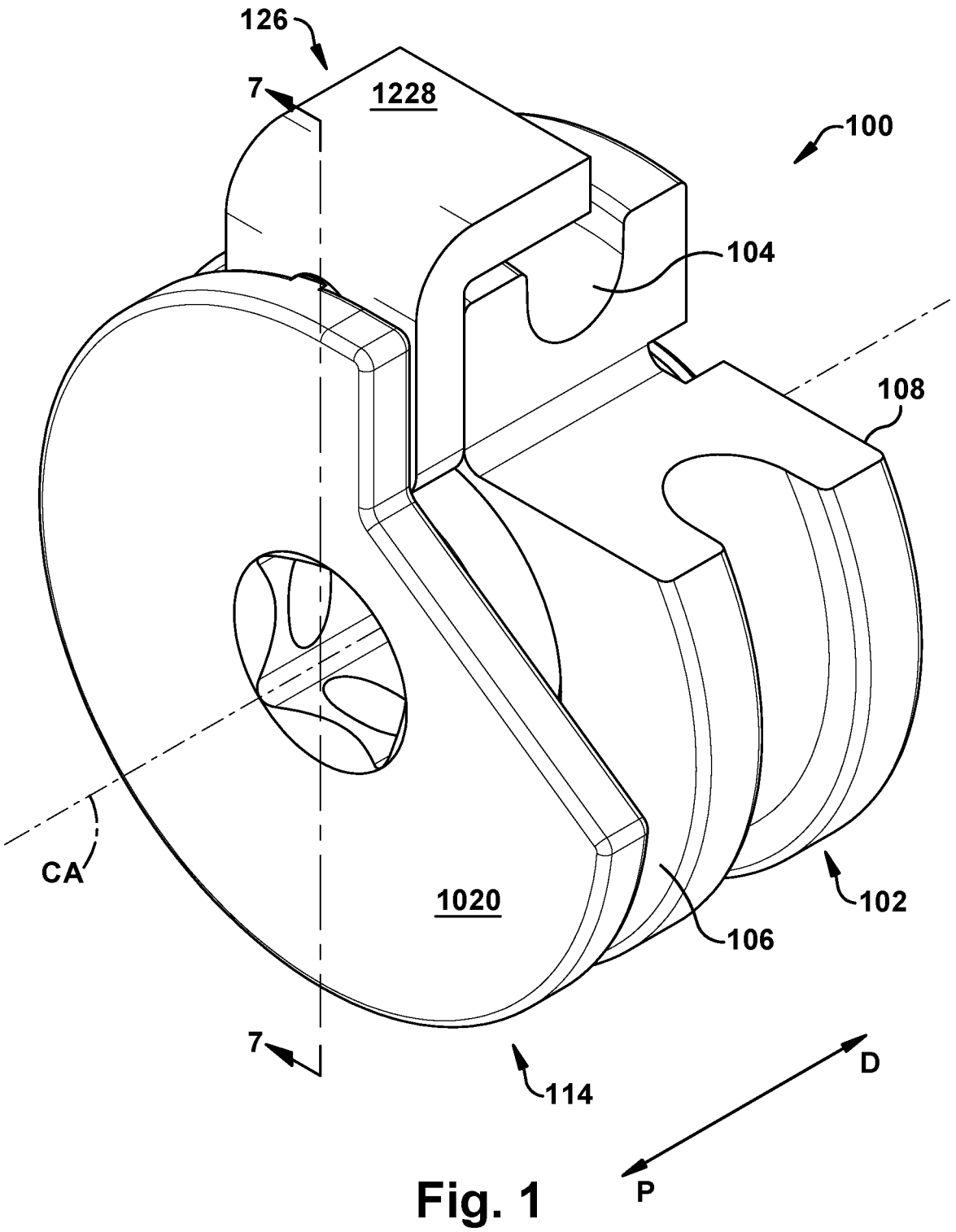
FIG. 1 is a perspective view of an aspect of the present invention.

Unless defined otherwise, all technical and scientific terms used herein have the same meaning as is commonly understood by one of skill in the art to which the present disclosure pertains.

As used herein, the singular forms "a," "an" and "the" can include the plural forms as well, unless the context clearly indicates otherwise. It will be further understood that the terms "comprises" and/or "comprising," as used herein, can specify the presence of stated features, steps, operations, elements, and/or components, but do not preclude the presence or addition of one or more other features, steps, operations, elements, components, and/or groups thereof.

As used herein, the term "and/or" can include any and all combinations of one or more of the associated listed items.

As used herein, phrases such as "between X and Y" and "between about X and Y" can be interpreted to include X and Y.

As used herein, phrases such as "between about X and Y" can mean "between about X and about Y."

As used herein, phrases such as "from about X to Y" can mean "from about X to about Y."

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "directly adjacent" another feature may have portions that overlap or underlie the adjacent feature, whereas a structure or feature that is disposed "adjacent" another feature might not have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms can encompass different orientations of a device in use or operation, in addition to the orientation depicted in the figures. For example, if a device in the figures is inverted, elements described as "under" or "beneath" other elements or features would then be oriented "over" the other elements or features.

It will be understood that, although the terms "first," "second," etc. may be used herein to describe various elements, these elements should not be limited by these terms. These terms are only used to distinguish one element from another. Thus, a "first" element discussed below could also be termed a "second" element without departing from the teachings of the present disclosure. The sequence of operations (or steps) is not limited to the order presented in the claims or figures unless specifically indicated otherwise.

The invention comprises, consists of, or consists essentially of the following features, in any combination.

Figure 3:
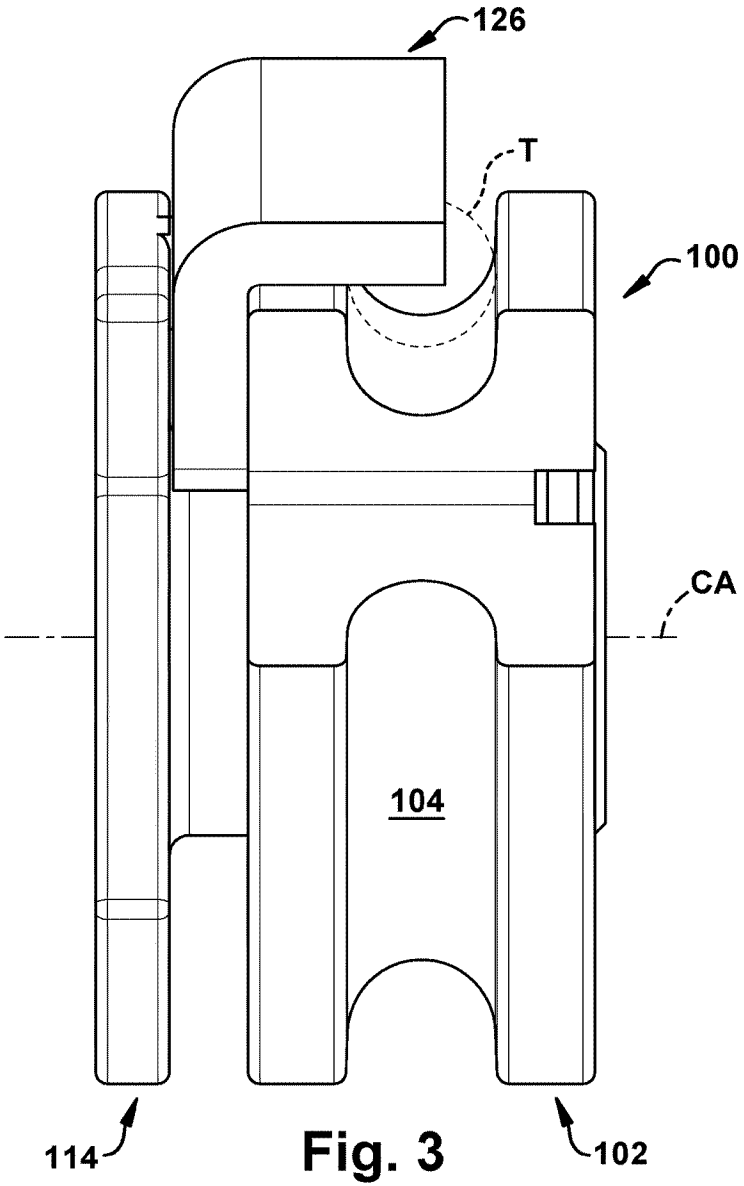
FIG. 3 is a side view of the aspect of FIG. 1.
Figure 2:
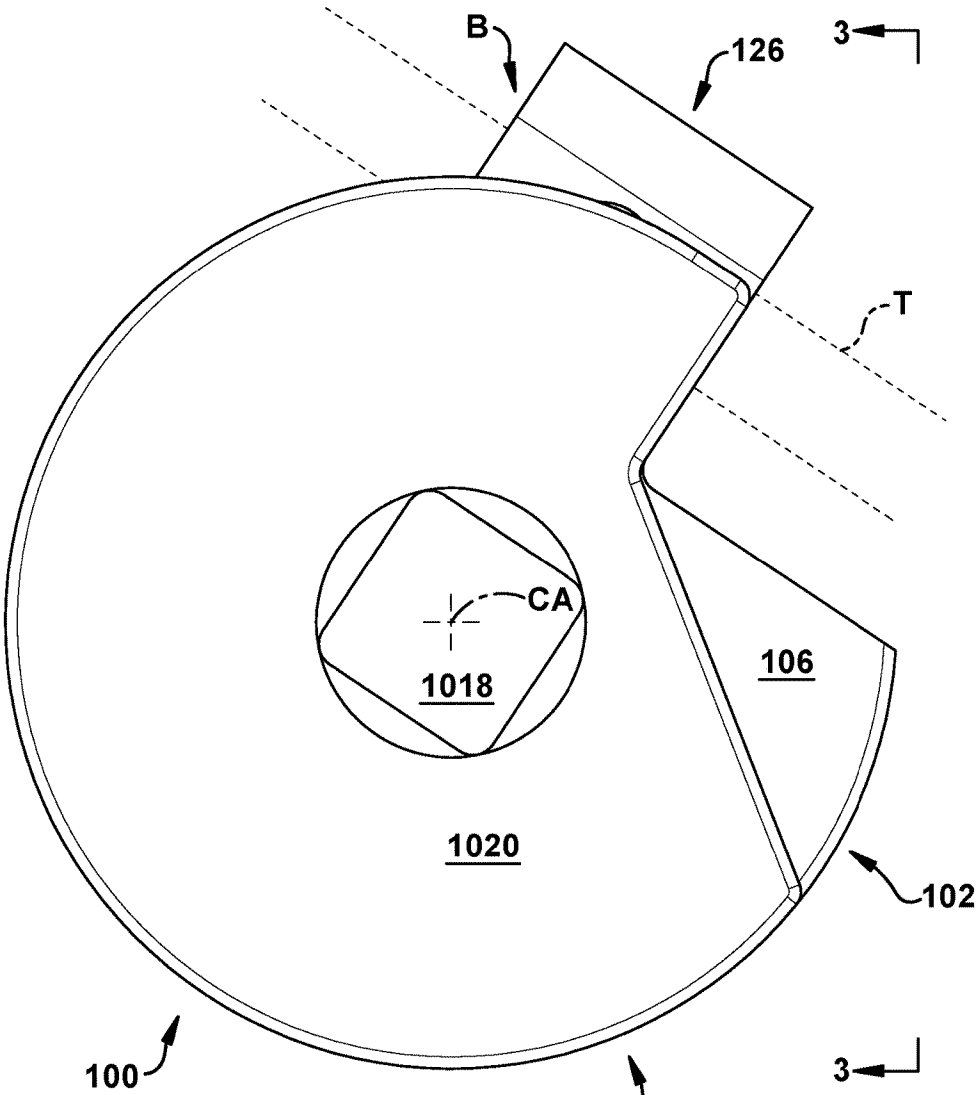
FIG. 2 is a front view of the aspect of FIG. 1.
Figure 4:
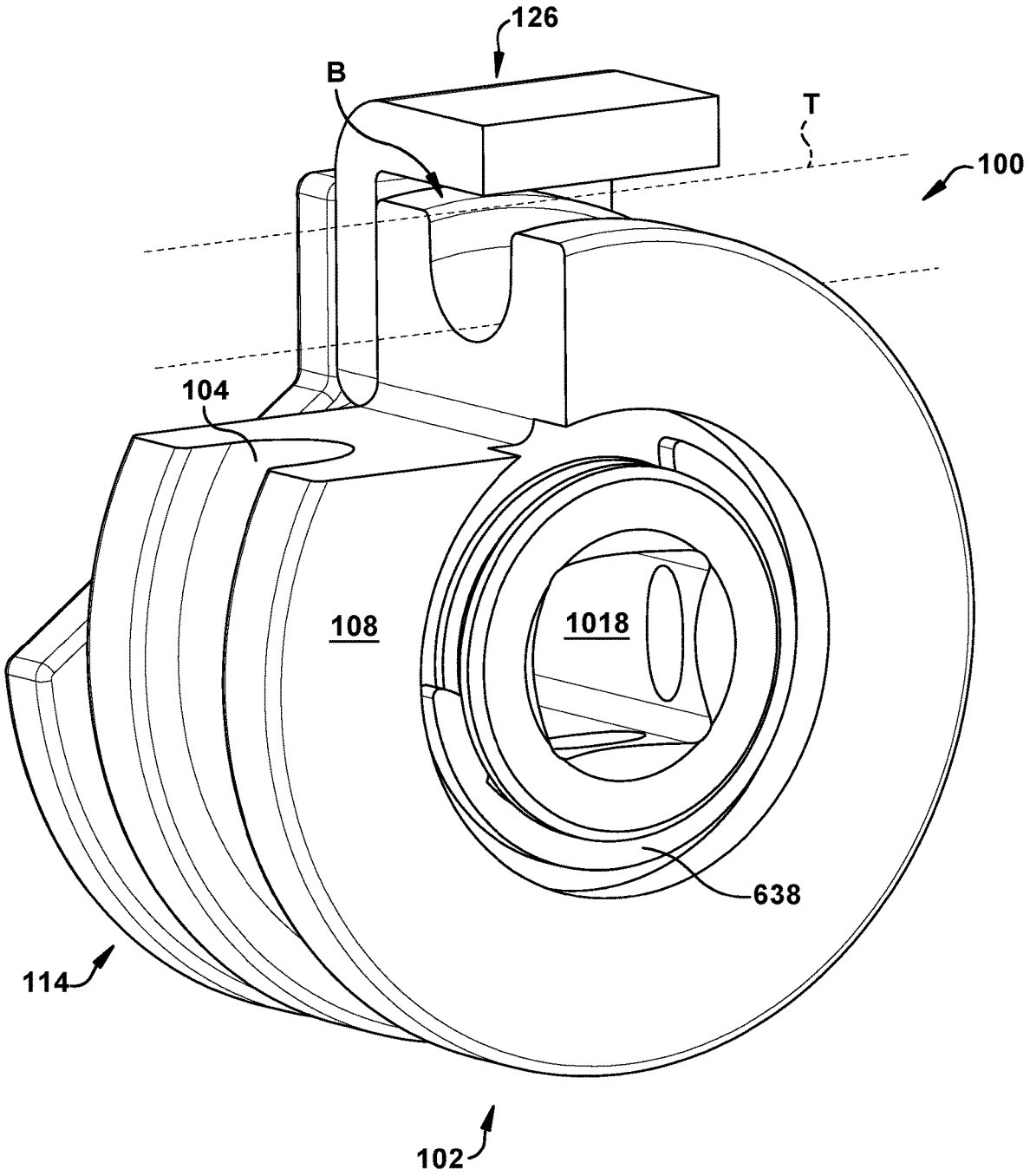
FIG. 4 is a rear view of the aspect of FIG. 1.
Figure 5:
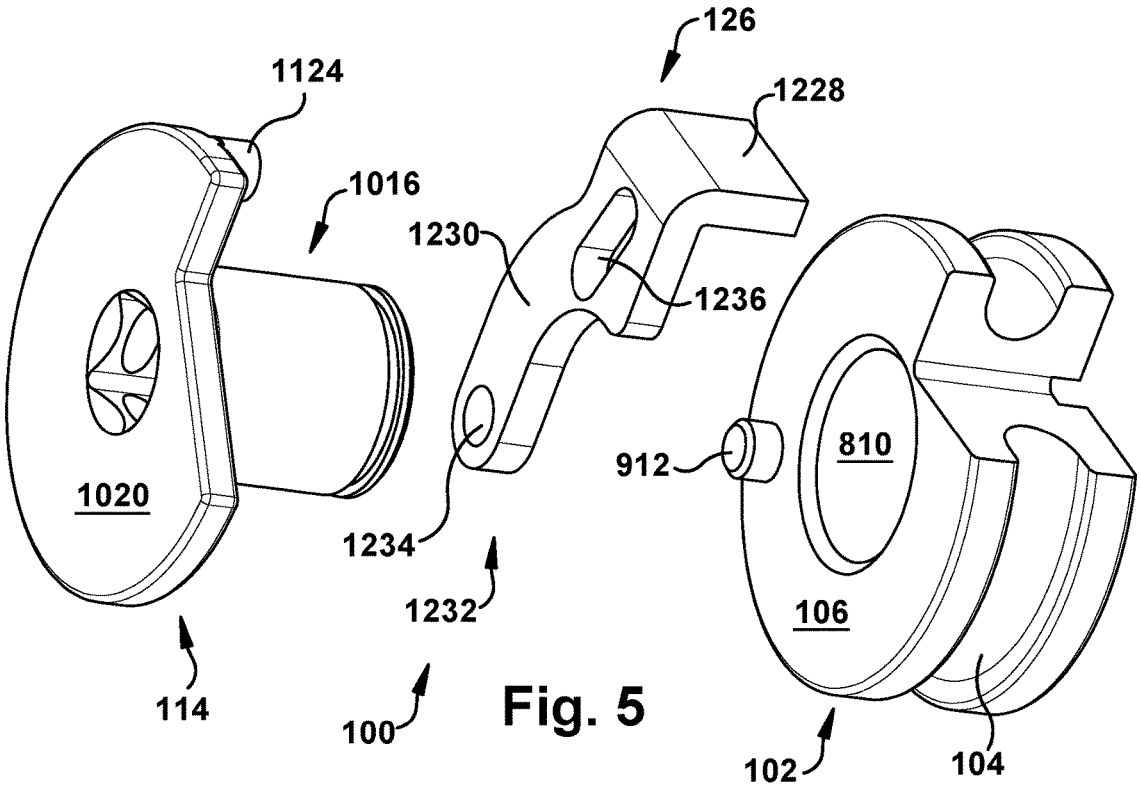
FIG. 5 is an exploded front perspective view of the aspect of FIG. 1.
Figure 6:
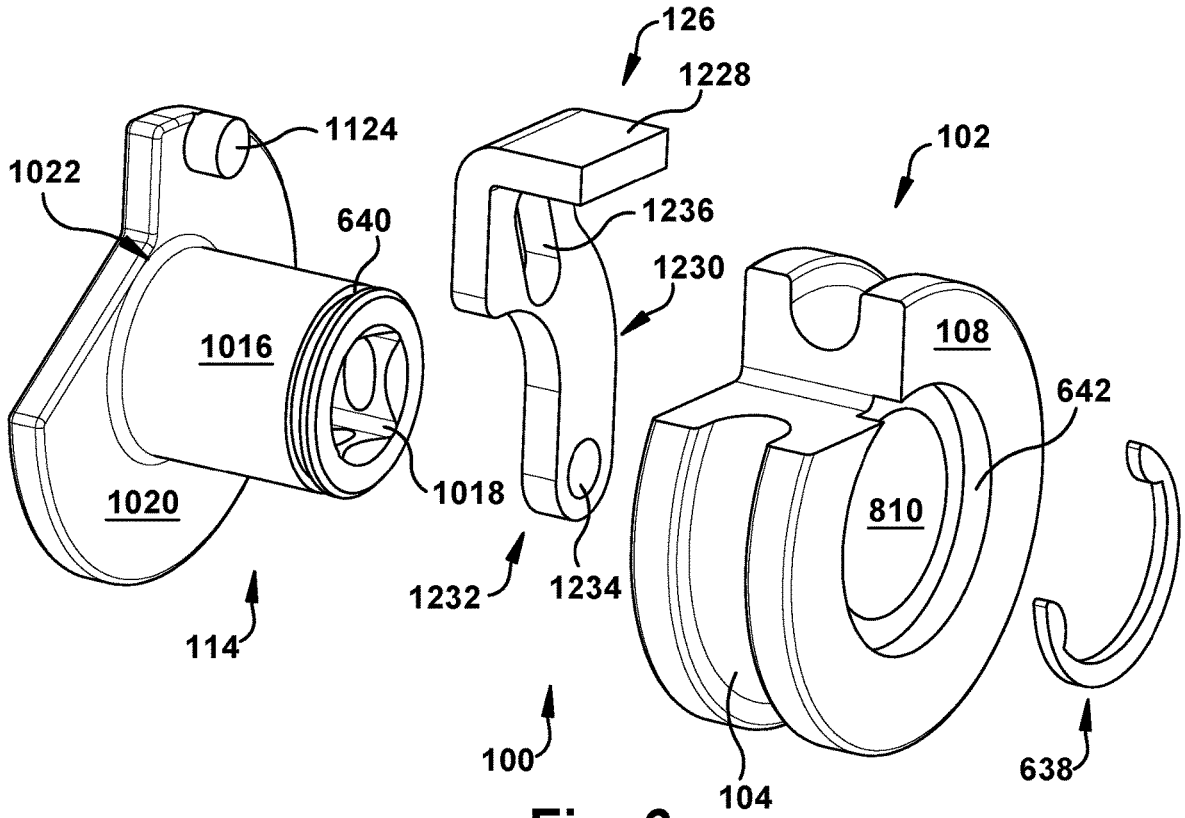
FIG. 6 is an exploded rear perspective view of the aspect of FIG. 1.
Figure 7:
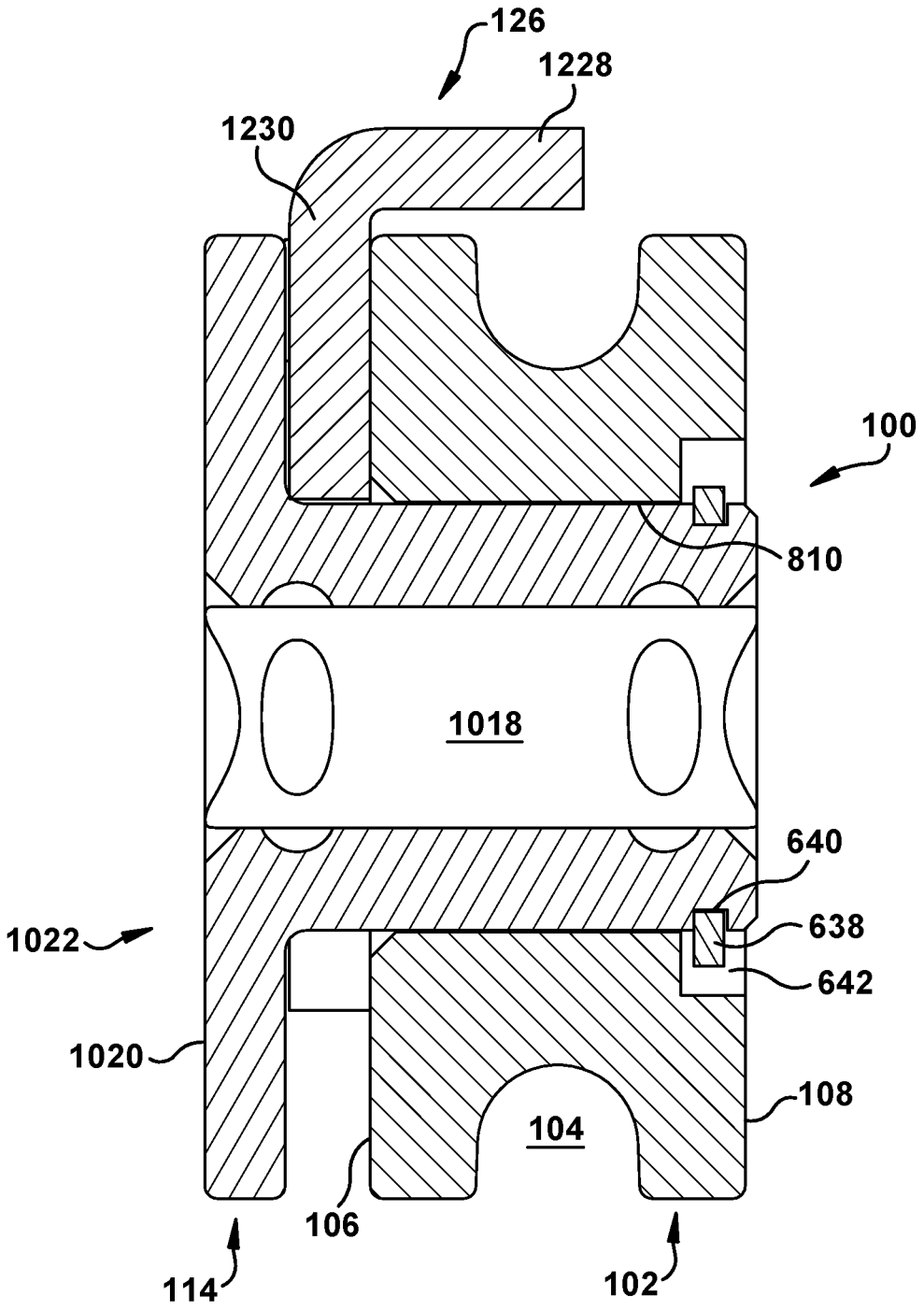
FIG. 7 is a cross-sectional view taken along line 7-7 of FIG. 1.
Figure 9:
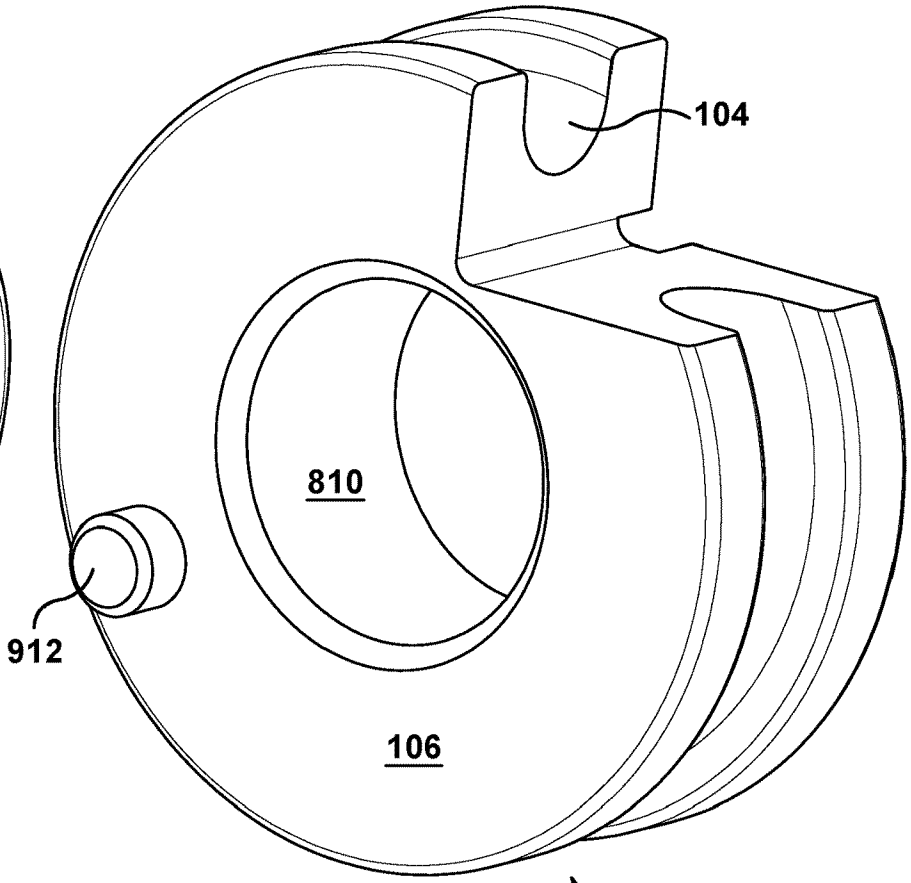
FIG. 9 is a perspective front view of the component of FIG. 8.
Figure 8:
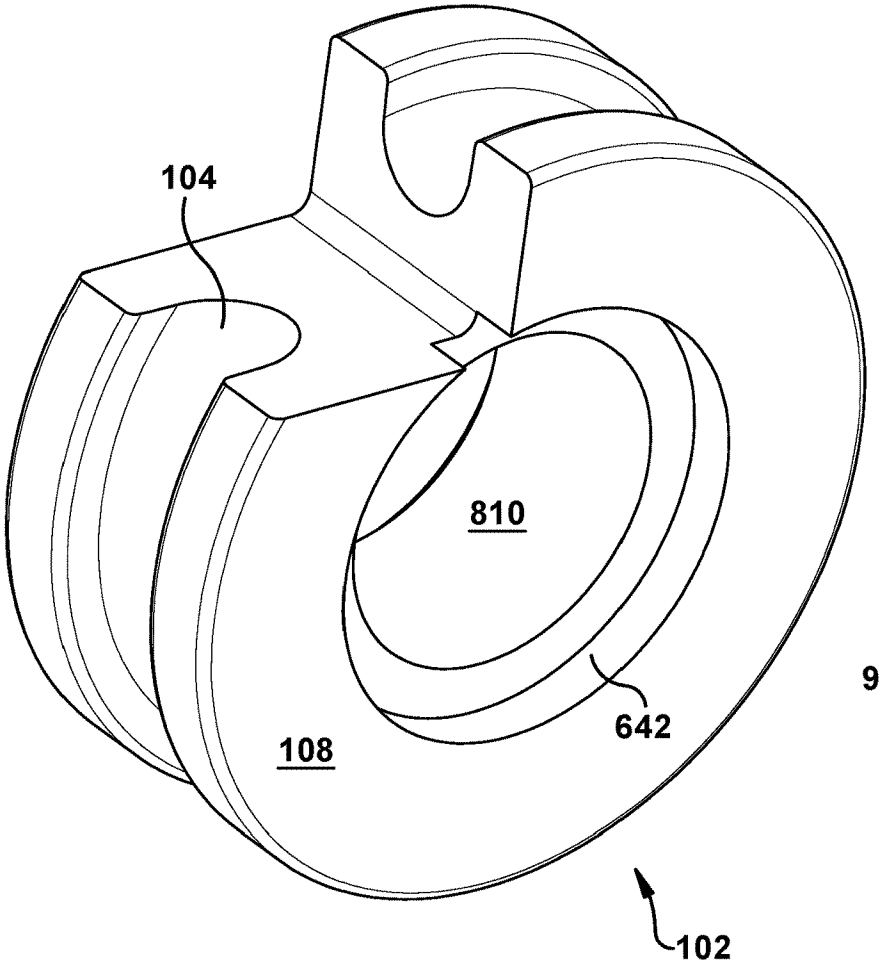
FIG. 8 is a perspective rear view of a component of the aspect of FIG. 1.

FIGS. 1-7 depict various views of a first aspect of a tube bending apparatus 100, with a tube "T" shown schematically in dashed line in FIGS. 2-4. A bending wheel 102 includes a circumferential tube-accepting recess 104 and oppositely facing proximal and distal wheel faces 106 and 108, respectively. (The "proximal" and "distal" directions, as used herein, are shown by the "P" and "D" arrows in FIG. 1.) The bending wheel 102, shown in more detail in FIGS. 8-9, includes a rotation recess (shown in FIG. 8 at 810 as a cylindrical rotation recess) extending longitudinally through the bending wheel 102 between the proximal and distal wheel faces 106 and 108 along a central axis CA of the bending wheel 102. The "longitudinal" direction, as shown and referenced herein, is a direction substantially parallel to the central axis CA shown in the Figures. The proximal wheel face 106 includes a lever pivot anchor 912.

The bending wheel 102 is shown as having an "L" shaped chunk taken out of the circumference thereof, but a full, uninterrupted cylindrical/circular profiled bending wheel 102, or a bending wheel 102 with a different circumferential profile, is also contemplated. The tube-accepting recess 104 is shown in the Figures as having a "U"-shaped cross-section, and extending entirely about a rounded outer circumference of the bending wheel 102, but one of ordinary skill in the art could readily configure a suitable tube-accepting recess 104 for a particular use environment.

Figure 11:
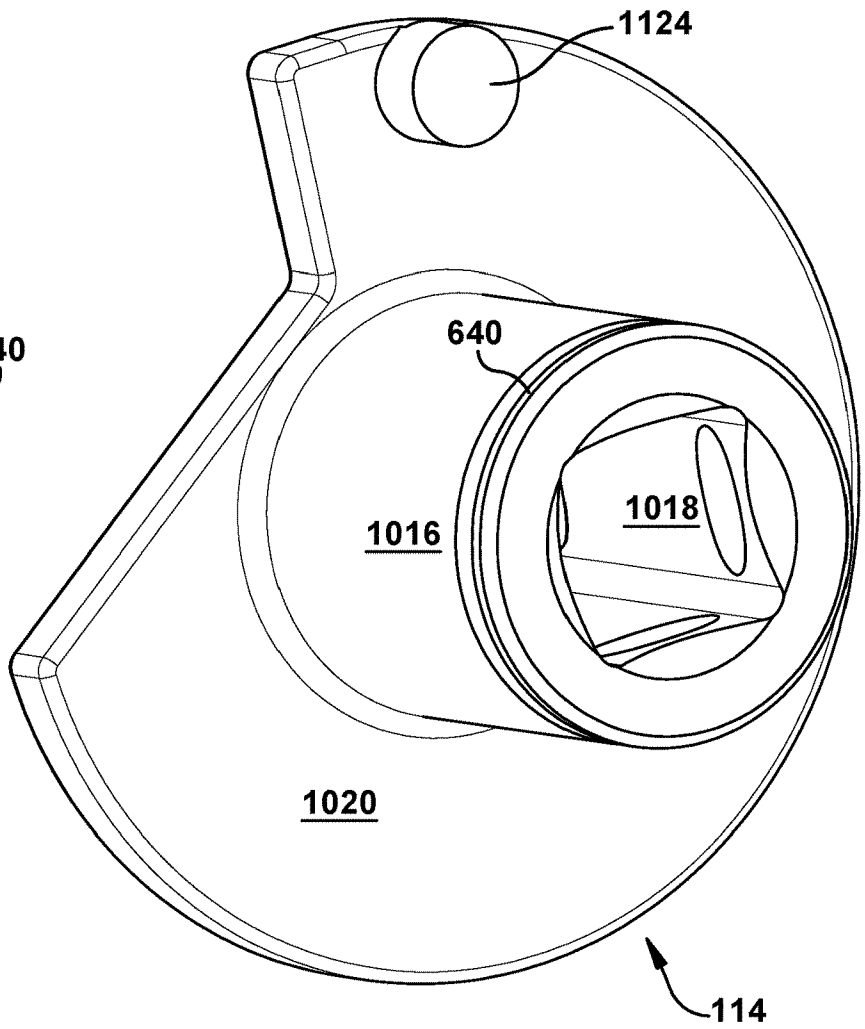
FIG. 11 is a perspective rear view of the component of FIG. 10.
Figure 10:
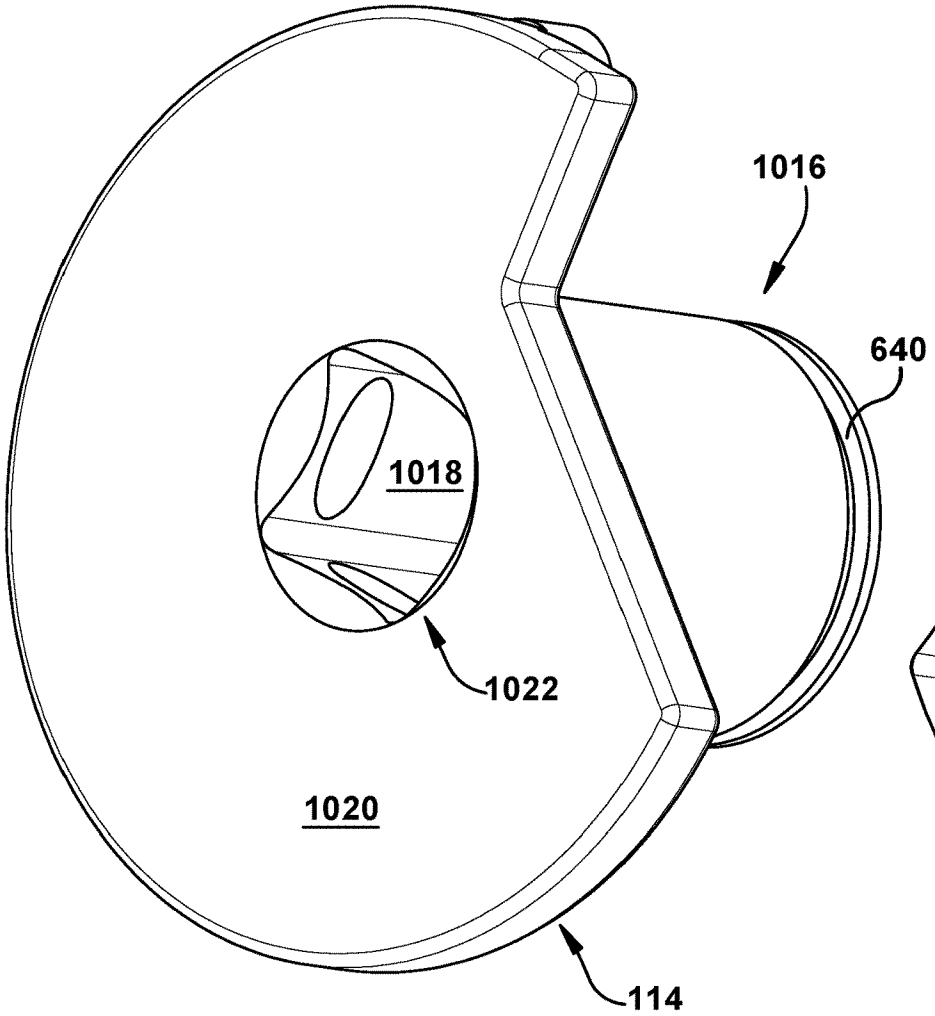
FIG. 10 is a perspective front view of a component of the aspect of FIG. 1.

A cam insert 114 (shown in more detail in FIGS. 10-11) includes a longitudinally extending shaft 1016 having a tool driving feature 1018 extending coaxially at least partially therethrough. The shaft, which may be a cylindrical shaft, 1016 is configured for selective insertion into the rotation recess 810 of the bending wheel 102, with the shaft 1016 being selectively rotatable with respect to the rotation recess 810. The cam insert 114 includes a camming flange 1020 extending laterally from at least a portion of a proximal face 1022 of the shaft 1016. The "lateral" direction, as shown and used herein, is a direction substantially within a plane which is substantially perpendicular to the longitudinal direction. The camming flange 1020 includes a lever urging feature 1124 spaced laterally apart from the tool driving feature 1018.

Figure 12:
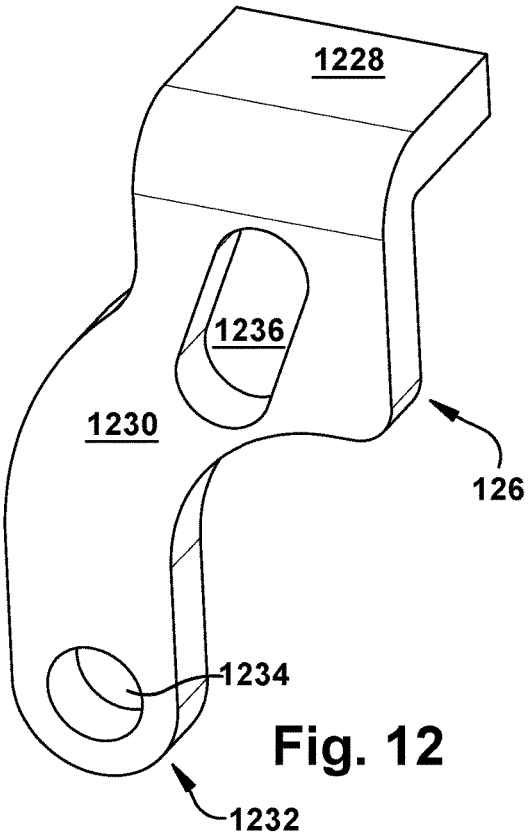
FIG. 12 is a perspective front view of a component of the aspect of FIG. 1.
Figure 13:
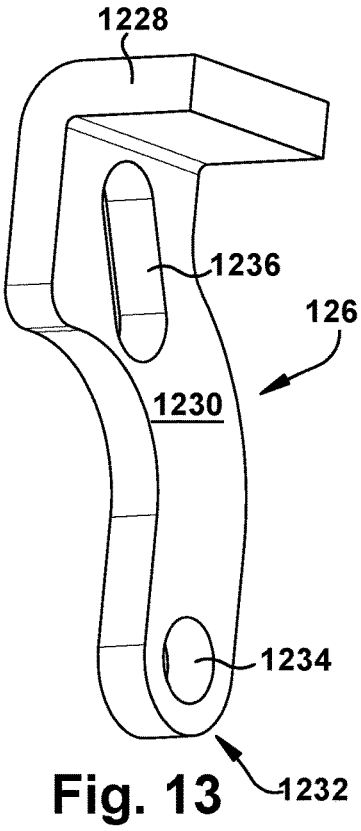
FIG. 13 is a perspective rear view of the component of FIG. 12.

A keeper lever 126 (shown in more detail in FIGS. 12-13) includes a longitudinally extending keeper finger 1228 rigidly connected to an outboard end of a laterally extending lever arm 1230. The term "outboard" is used herein to indicate a direction further from the central axis CA than an "inboard" direction. When the tube bending apparatus 100 is assembled, the keeper finger 1228 extends longitudinally from the proximal wheel face 106 to at least a proximal-most portion of the tube-accepting recess 104. Optionally, as shown in the assembled view of FIG. 1, the keeper finger 1228 could extend longitudinally across at least a portion of a circumferentially oriented "opening" of the tube-accepting recess 104 to at least partially "close off" or "cap" the tube-accepting recess 104, and may extend even further distally past the tube-accepting recess 1044 to completely span the tube-accepting recess 1044 in some use environments.

An anchor end 1232 of the lever arm 1230, located inboard of the keeper lever 126, can include an arm pivot feature 1234, configured to pivotally connect to the lever pivot anchor 912. The lever arm 1230 includes a cam following feature 1236 spaced apart from the arm pivot feature 1234. The cam following feature 1236 is configured to interact with the lever urging feature 1124 of the camming flange 1020.

When the tube bending apparatus 100 is in an assembled state, the shaft 1016 is selectively located at least partially within the rotation recess 810 to bring the camming flange 1020 in proximity to the proximal wheel face 106 (with the proximal wheel face 106 longitudinally interposed between the camming flange 1020 and the tube-accepting recess 104). As shown in the Figures, the camming flange 1020 could be spaced longitudinally apart from the proximal wheel face 106 by the keeper lever 126. An alternate arrangement includes the camming flange 1020 being longitudinally interposed between at least a portion of the keeper lever 126 and the proximal wheel face 106; one of ordinary skill in the art will be able to reconfigure the described structures to render such an arrangement workable.

Optionally, a snap ring 638 could be provided, for interaction with a ring groove 640 in the shaft 1016 of the cam insert 114 to retain the cam insert 114 in pivotable relation to the bending wheel 102. A cotter pin (not shown) or any other desired retention structure could be provided, also or instead of the snap ring 638 and ring groove 640 arrangement. Again as shown in the Figures, a countersink 642 could be provided in the distal wheel face 108, to prevent the snap ring 638 or another structure associated with the shaft 1016 from protruding distally beyond the distal wheel face 108.

When the tube bending apparatus 100 is assembled as shown in FIGS. 1-4, the arm pivot feature 1234 of the keeper lever 126 will be concurrently pivotally connected to (e.g., in pivotal contact with) the lever pivot anchor 912. Also, the cam following feature 1236 of the keeper lever 126 will be operatively connected (e.g., in pivotal contact with) the lever urging feature 1124. Accordingly, rotation of the cam insert 114 in a selected rotational direction (e.g., clockwise about the central axis CA) causes rotation of the lever urging feature 1124 in that same rotational direction, which responsively pulls or drives the cam following feature 1236 of the keeper lever 126 to pivot the lever arm 1230 in that same rotational direction about the lever pivot anchor 912.

Figure 14:
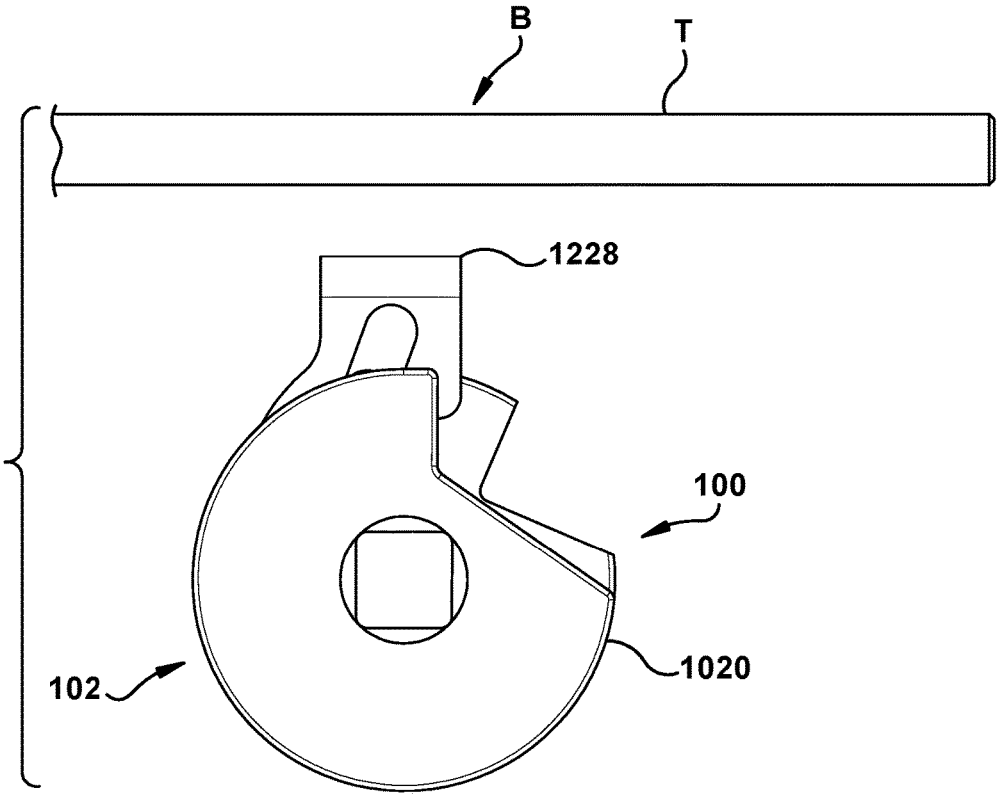
FIGS. 14-17 schematically illustrate a sequence of operation of the aspect of FIG. 1.

In order to bend a tube with the tube bending apparatus 100, the tube bending apparatus 100 may be employed as shown in the sequence of FIGS. 14-17. The shaft 1016 is located at least partially within the rotation recess 810 to bring the camming flange 1020 in proximity to the proximal wheel face 106. Concurrently, the arm pivot feature 1234 of the keeper lever 126 is pivotally connected to the lever pivot anchor 912. The cam following feature 1236 of the keeper lever 126 is operatively connected to the lever urging feature 1124. The tube bending apparatus 100 is then considered to be in an "assembled" state as shown in FIG. 14. This assembly could be accomplished at any desired time before use of the tube bending apparatus 100.

Figure 15:
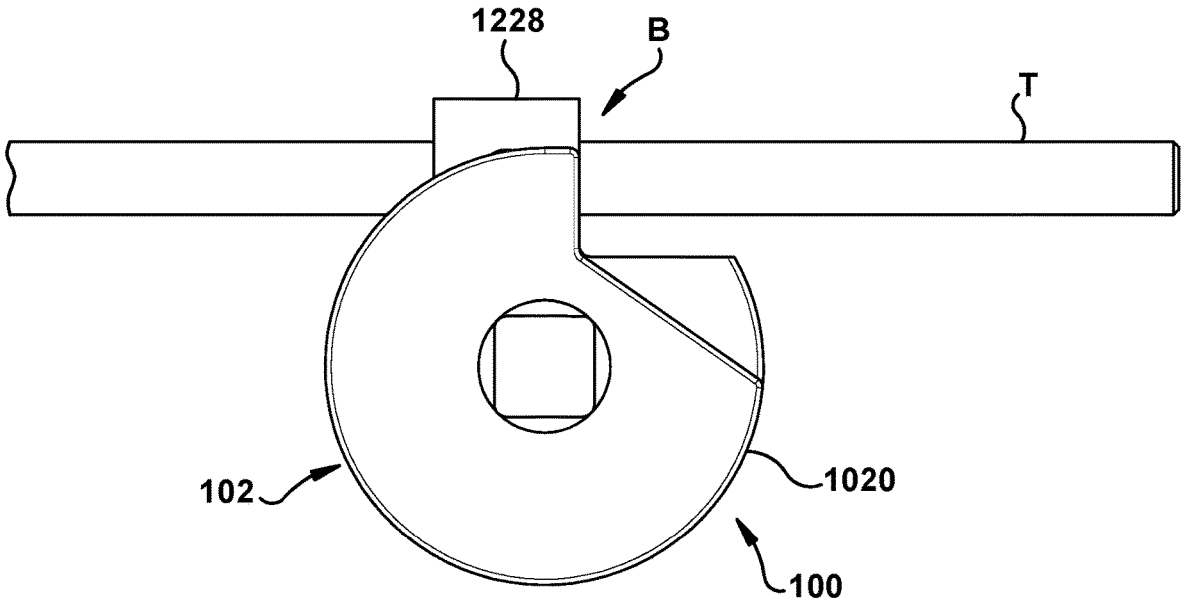

The tube "T" is placed at least partially in the tube-accepting recess 104 with a bending target portion (shown schematically at B) of the tube T—the bending target portion being spaced apart from at least one end of the tube T—in a tangent relationship to the bending wheel 102. This arrangement is shown in FIG. 15.

Rotation of the cam insert 114 is then driven in a selected rotational direction to responsively cause rotation of the lever urging feature 1124 in that rotational direction. For example, a driving tool, such as the square-head screwdriver shown at DT in FIG. 16, could be placed into operative relationship with a recess-type tool driving feature 1018, such as that shown in the Figures. Alternatively, a protrusion-type tool driving feature 1018 could be brought into an operative relationship with, for example, an aperture in a socket wrench (not shown).

With the lever urging feature 1124, the cam following feature 1236 of the keeper lever 126 is driven responsive to rotation of the cam insert 114, to pivot the lever arm 1230 in the selected rotational direction about the lever pivot anchor 912. The keeper finger 1228 moves laterally and is brought proximate the tube-accepting recess 104 through pivoting of the lever arm 1230 in the selected rotational direction about the lever pivot anchor 912.

Figure 16:
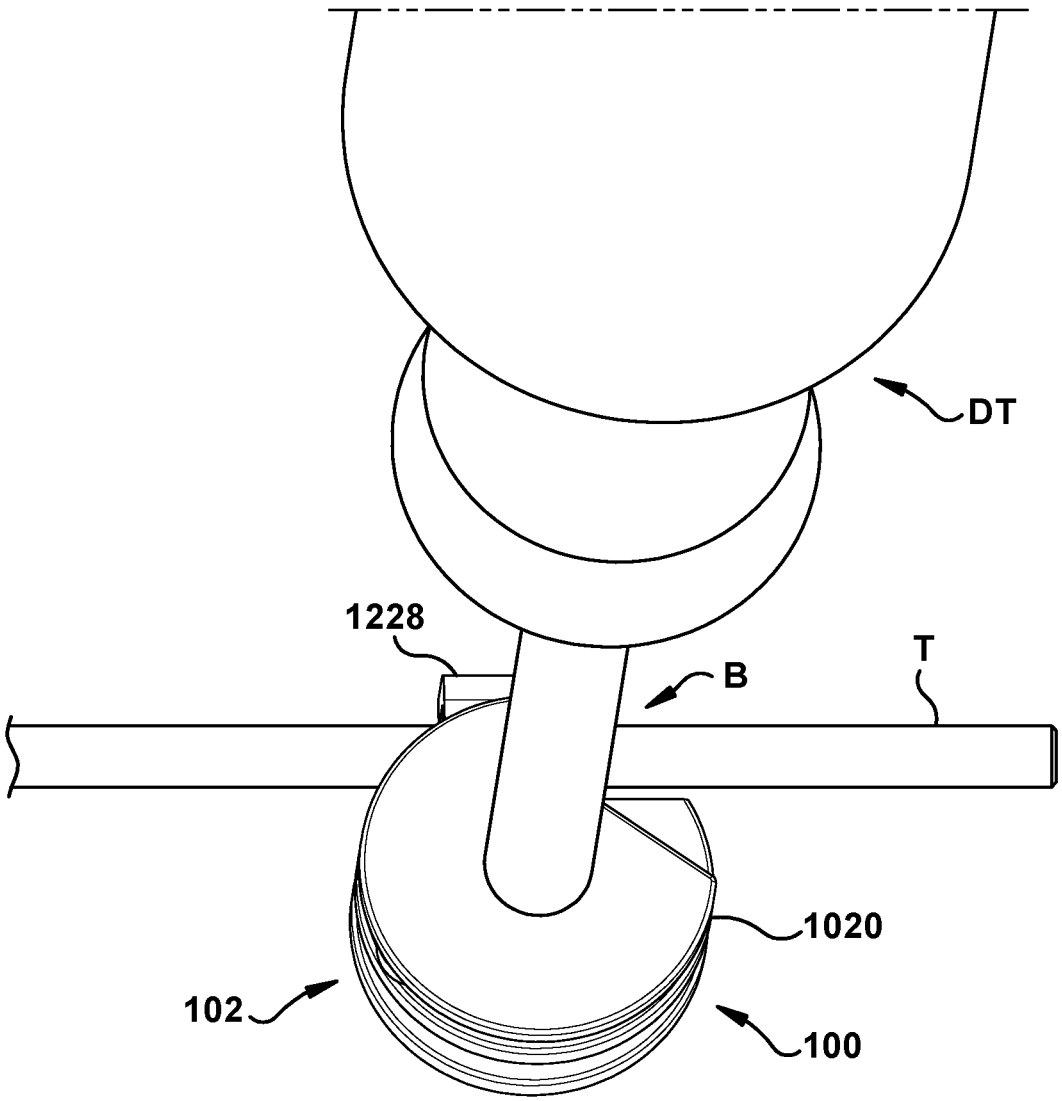
Figure 17:
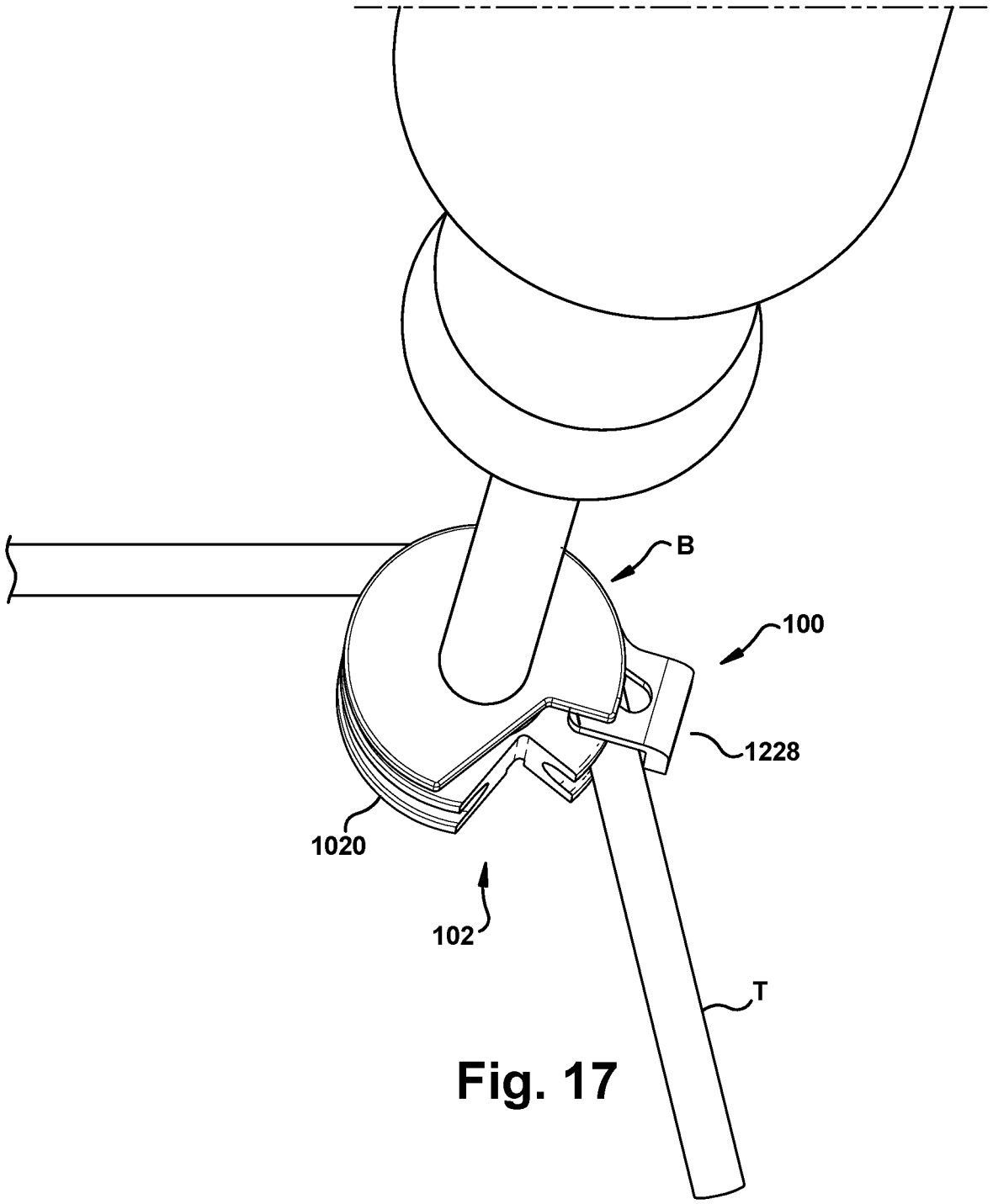
Figure 18:
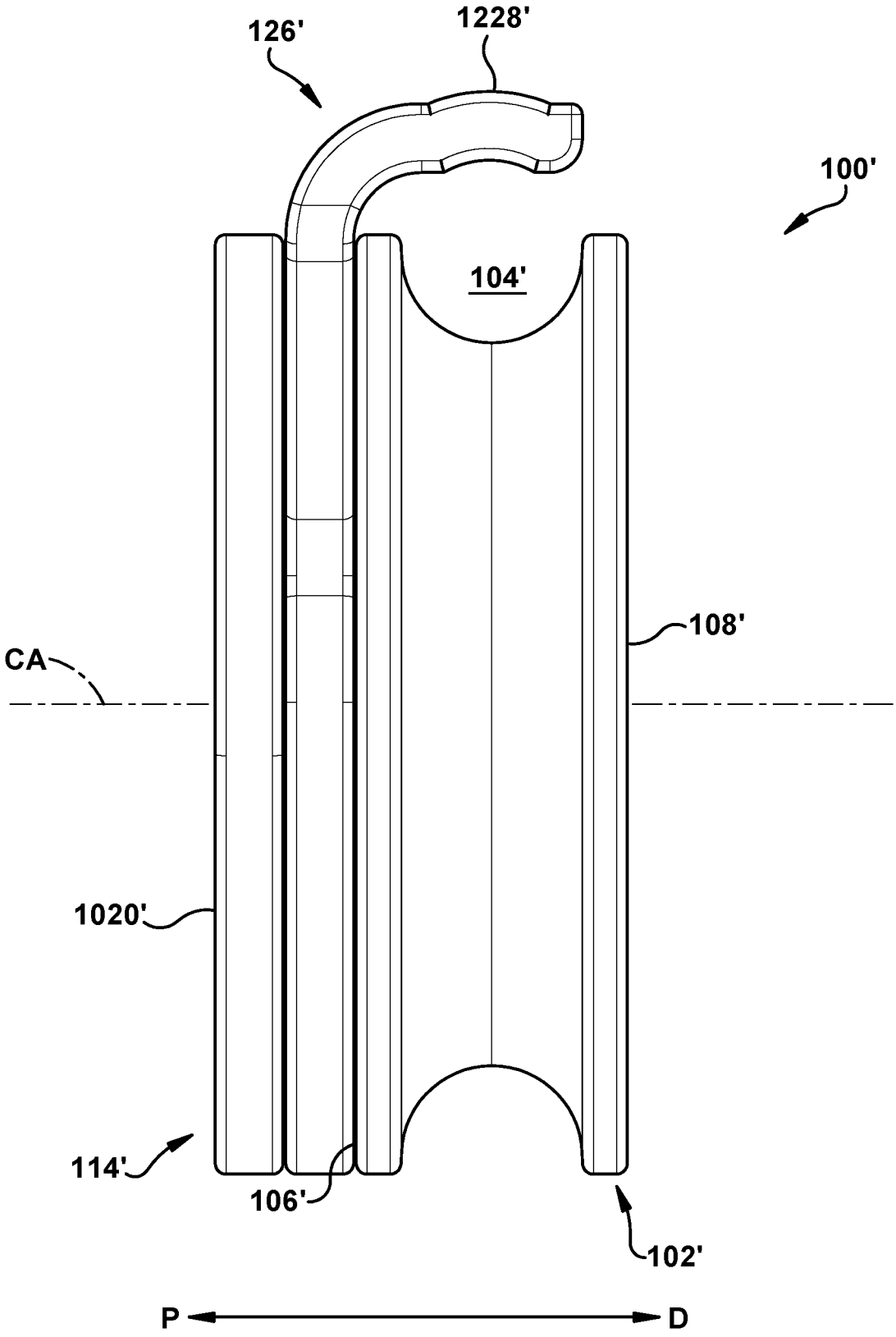
FIG. 18 is a side view of an aspect of the present invention.
Figure 19:
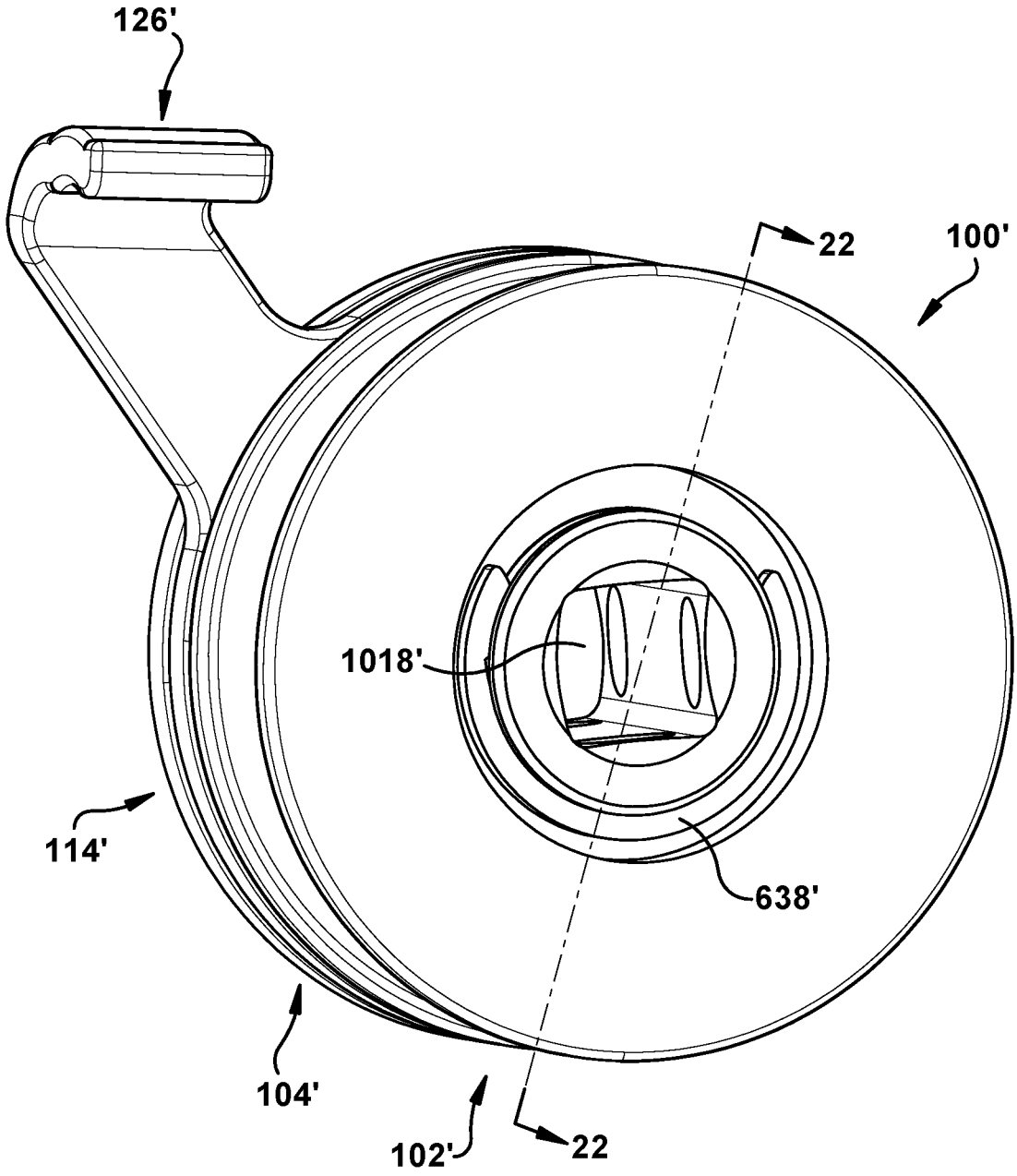
FIG. 19 is a rear view of the aspect of FIG. 18.

A spatial position of the at least one end of the tube T is maintained with respect to the tube bending apparatus 100. That is, the tube T is held steady, as shown in the sequence of FIGS. 16-17. The tube bending apparatus 100 is rotated in the selected rotational direction with the keeper finger 1228 held proximate the tube-accepting recess 104. With the keeper finger 1228, egress of the tube T from the tube-accepting recess 104 is prevented. That is, the keeper finger 1228 presses laterally against the tube T as the tube bending apparatus 100 turns, with a driving force being transmitted from the tool driving feature 1018, through the interface between the lever urging feature 1124 and the cam following feature 1236, and then to the keeper finger 1228 to press the tube T laterally down into the tube-accepting recess 104.

As a result of the interactions between the components of the tube bending apparatus 100, the tube T is at least partially wrapped around the bending wheel 102 to bend the tube T due to the combination of the differently-directed forces applied to the tube T by the keeper finger 1228 and the maintained spatial position of the at least one end of the tube T. That is, the user holds at least one end of the tube T steady, with the target bending portion B of the tube T held in the tube-accepting recess 104, and the keeper finger 1228 holds the target bending portion B against the bending wheel 102, and the forces exerted on and by the tube bending apparatus 100 bend the target bending portion B as desired. Accordingly, the user can impart a desired degree of bend to the tube T, either to "tweak" an existing bend or to bend a straight tube T in the first place, as shown in FIG. 17.

Stated differently, the rotation of the cam insert 114 with respect to the bending wheel 102 urges the keeper finger 1228 to more firmly clamp down on the tube T in order to hold the tube T within the tube-accepting recess 104. The rotation of the tube bending apparatus 100, in combination with the keeper finger 1228 holding the tube T within the tube-accepting recess 104 and the user's holding the "free end" of the tube T, causes the tube T to be pivoted, and thus bent, around the tube-accepting recess 104. The bent tube T can then be removed from the tube bending apparatus 100 in any desired manner, including, but not limited to, sliding the tube bending apparatus 100 from one end of the bent tube T and/or reversing the rotation of the tube bending apparatus to release the bent tube T from the keeper finger 1228.

It should be noted that the user of the tube bending apparatus 100 does not need to separately operate the keeper lever 126, or portions thereof (such as by the elongated lever handles provided to prior art devices) in order to maintain the tube T within the tube-accepting recess 104 during the tube-bending operation. Instead, rotational force imparted by a driving tool on the tube bending apparatus 100 serve both to "clamp" the keeper finger 1228 laterally downward toward the tube-accepting recess 104, as well as to actually impart a sufficient force upon the target bending portion B of the tube T to accomplish the desired bending function.

Optionally, the tool driving feature 1018 could be employed to rotate the cam insert 114 in an appropriate rotational direction to move the keeper finger 1228 toward or away from the tube-accepting recess 104, to allow for "loading" type insertion of the tube T into the tube-accepting recess 104 and/or removal of the desirably bent tube T from the tube bending apparatus 100.

FIGS. 19-23 illustrate a second embodiment of a tube bending apparatus 100'. The tube bending apparatus 100' of FIGS. 19-23 is similar to the tube bending apparatus 100 of FIGS. 1-17 and therefore, structures of FIGS. 19-23 that are the same as or similar to those described with reference to FIGS. 1-17 have the same reference numbers with the addition of a "prime" mark. Description of common elements and operation similar to those in the previously described first embodiment will not be repeated with respect to the second embodiment, but should instead be considered to be incorporated below by reference as appropriate. As can be seen in FIGS. 19-23, the tube bending apparatus 100' of the second embodiment can be considered to differ from the tube bending apparatus 100 of the first embodiment in at least two ways.

Figure 23:
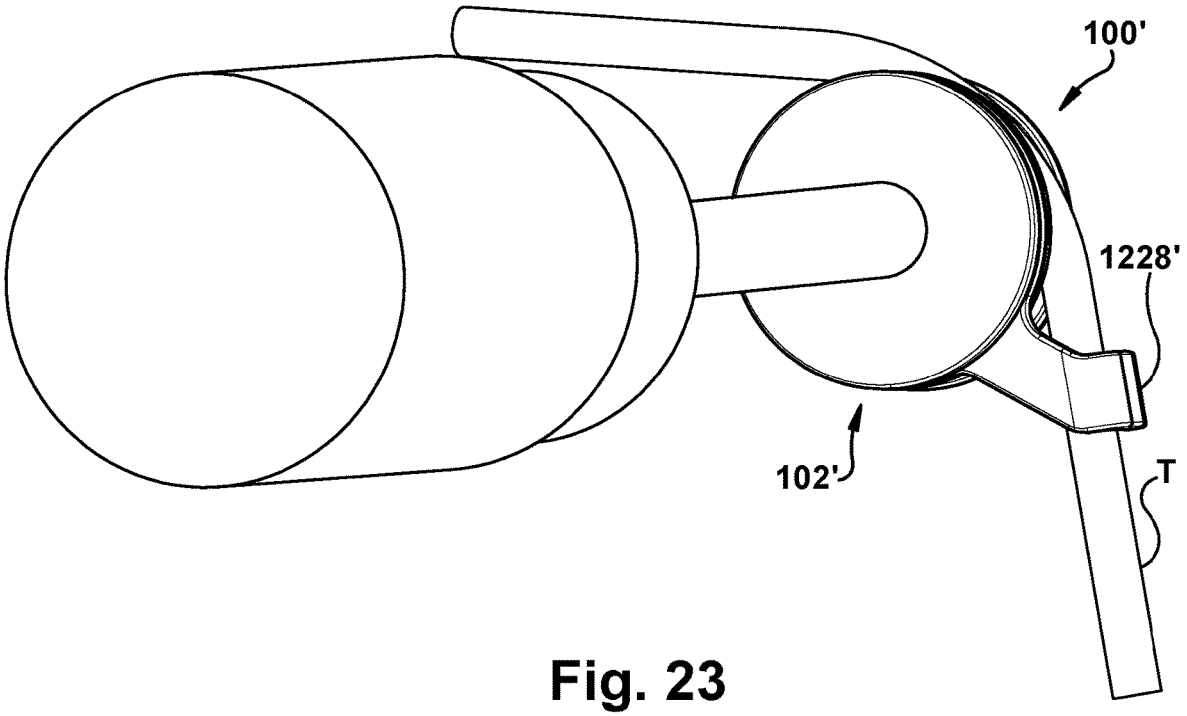
FIG. 23 is a front view of the aspect of FIG. 18 in an example use environment.

First, and as shown in at least FIGS. 19-21 and 23, the keeper lever 126' is angled with respect to the bending wheel 102' and is cantilevered radially outward from the bending wheel 102'. As shown in FIG. 23, this allows the keeper finger 1228' to achieve a longer bending moment from the rotation recess 810' and therefore assist with bending certain types of tube T.

Figure 20:
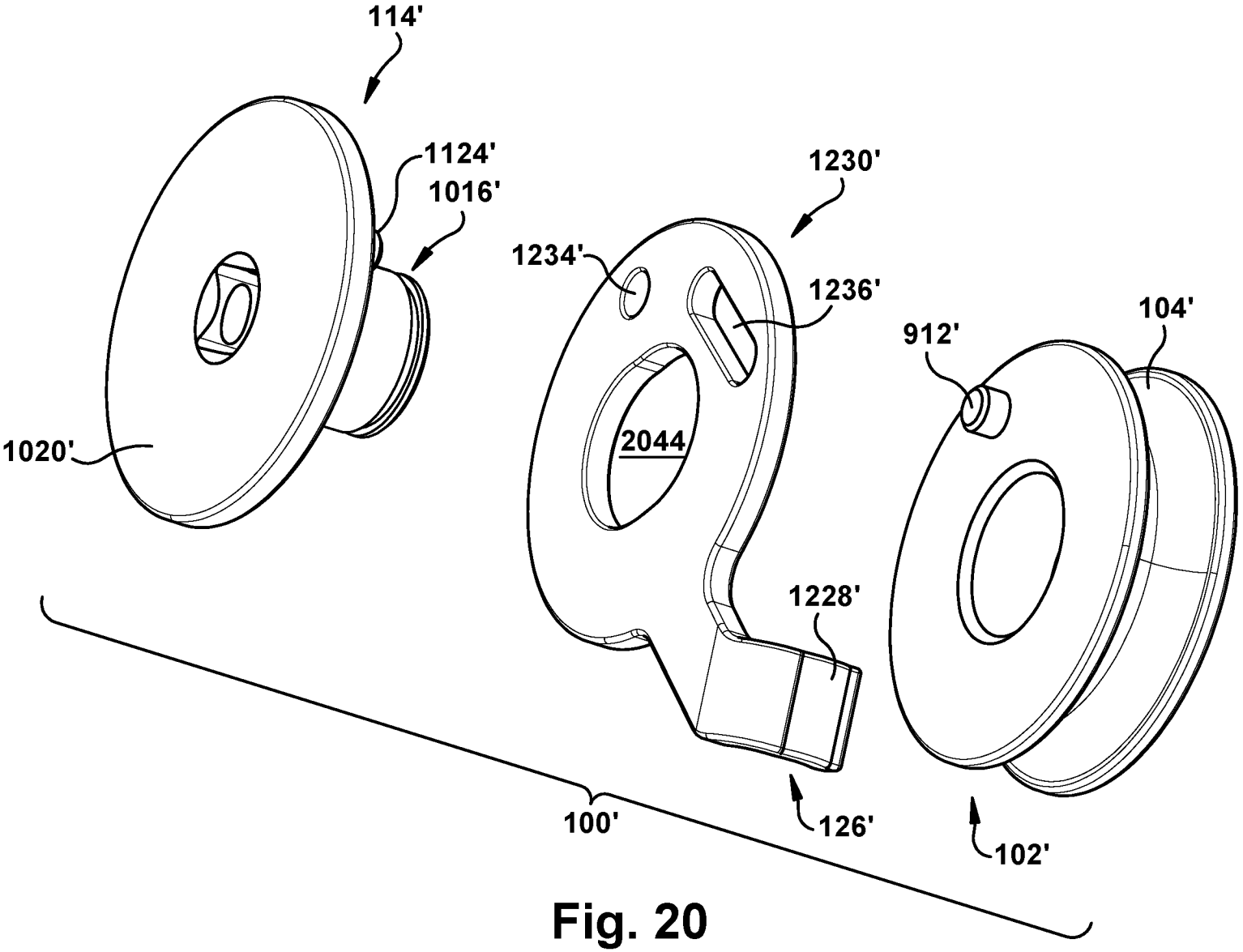
FIG. 20 is an exploded perspective front view of the aspect of FIG. 18.
Figure 21:
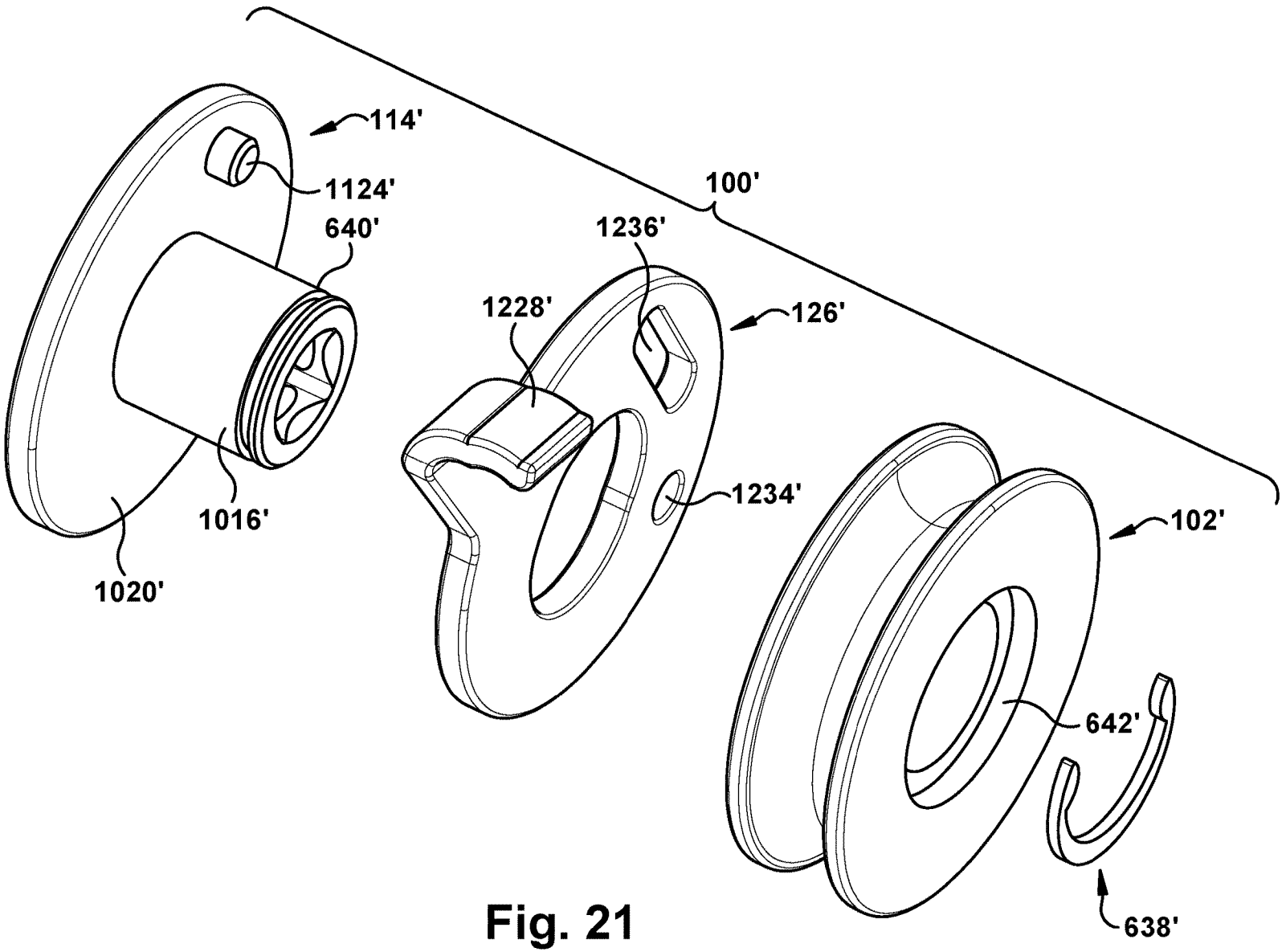
FIG. 21 is an exploded perspective rear view of the aspect of FIG. 18.
Figure 22:
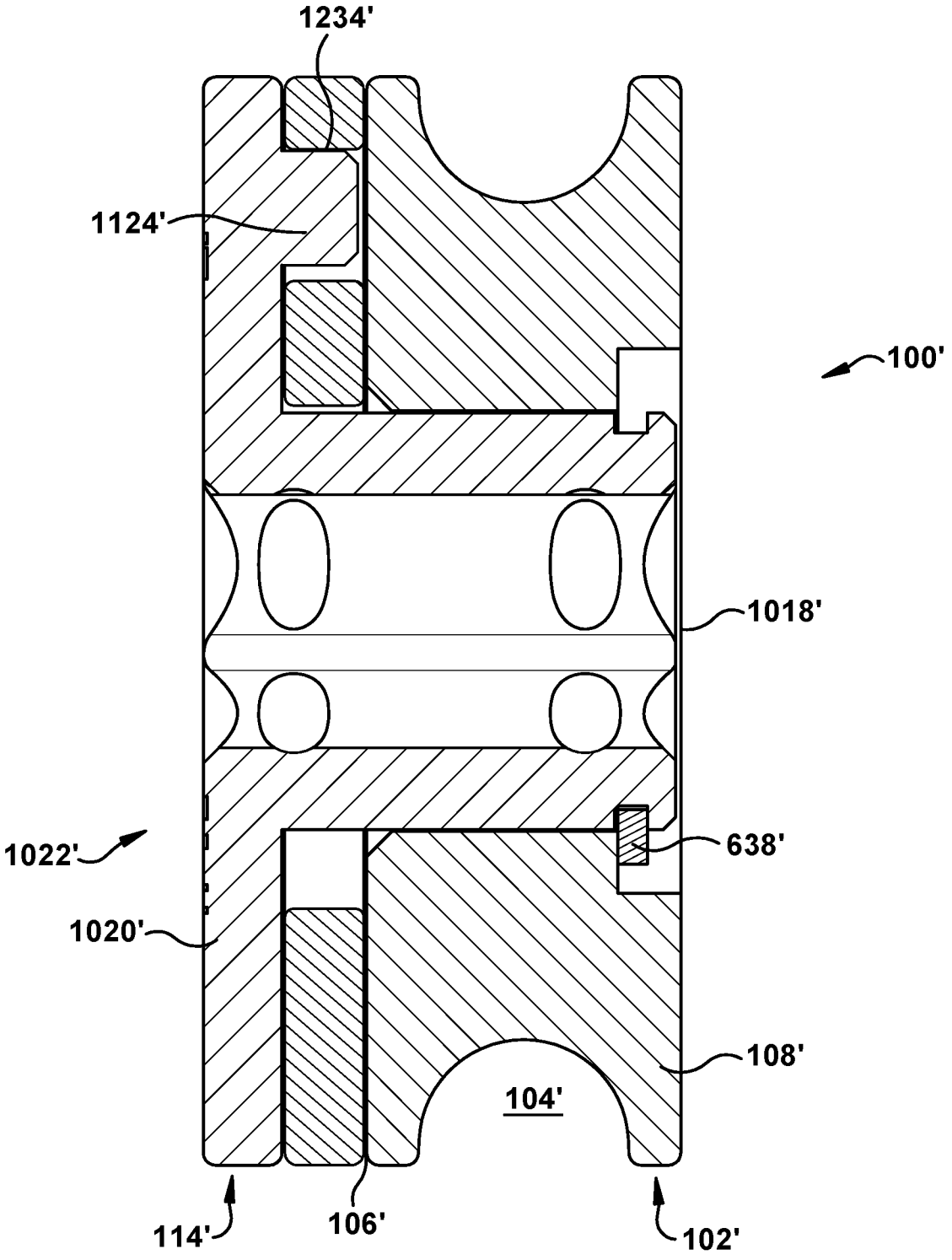
FIG. 22 is a cross-sectional view taken along line 22-22 of FIG. 19.

Another difference between the tube bending apparatus 100' of the second embodiment can be considered to differ from the tube bending apparatus 100 of the first embodiment is that the lever arm 1230', as shown in at least FIG. 20, includes a lever aperture 2044. The lever aperture 2044 is configured to selectively accept at least a portion of the shaft 1016' therethrough, and thus assist with positioning of, and force transfer between, various components of the tube bending apparatus 100'.

Certain structures and components are shown in the Figures and described herein as protruding from another element or being recessed into another element. However, these are not required configurations; it is contemplated that the "protruding" structures could be recessed, and vice versa, for a particular configuration of the tube bending apparatus 100 and one of ordinary skill in the art will be readily able to provide suitably configured components for a particular use environment of the present invention.

While aspects of this disclosure have been particularly shown and described with reference to the example aspects above, it will be understood by those of ordinary skill in the art that various additional aspects may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. In an effort to maintain clarity in the Figures, certain ones of duplicative components shown have not been specifically numbered, but one of ordinary skill in the art will realize, based upon the components that were numbered, the element numbers which should be associated with the unnumbered components; no differentiation between similar components is intended or implied solely by the presence or absence of an element number in the Figures. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking potentially aiding a user in selecting one component from an array of similar components for a particular use environment. A "predetermined" status may be determined at any time before the structures being manipulated actually reach that status, the "predetermination" being made as late as immediately before the structure achieves the predetermined status. The term "substantially" is used herein to indicate a quality that is largely, but not necessarily wholly, that which is specified—a "substantial" quality admits of the potential for some relatively minor inclusion of a non-quality item. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one aspect or configuration could be provided, singly or in combination with other structures or features, to any other aspect or configuration, as it would be impractical to describe each of the aspects and configurations discussed herein as having all of the options discussed with respect to all of the other aspects and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

We claim:

1. A tube bending apparatus, comprising:

a bending wheel including a circumferential tube-accepting recess and oppositely facing proximal and distal wheel faces, the bending wheel including a rotation recess extending longitudinally through the bending wheel between the proximal and distal wheel faces along a central axis of the bending wheel, and the proximal wheel face including a lever pivot anchor;

a cam insert including a longitudinally extending shaft having a tool driving feature extending coaxially at least partially therethrough, the shaft being configured for selective insertion into the rotation recess, the cam insert including a camming flange extending laterally from at least a portion of a proximal face of the shaft, the camming flange including a lever urging feature spaced laterally apart from the tool driving feature; and a keeper lever including a longitudinally extending keeper finger rigidly connected to an outboard end of a laterally extending lever arm, the keeper finger extending longitudinally from the proximal wheel face to at least a proximal-most portion of the tube-accepting recess, an anchor end of the lever arm including an arm pivot feature, the arm pivot feature being configured to pivotally connect to the lever pivot anchor, and the lever arm including a cam following feature spaced apart from the arm pivot feature, the cam following feature being configured to interact with the lever urging feature of the camming flange;

wherein the shaft is selectively located at least partially within the rotation recess to bring the camming flange in proximity to the proximal wheel face, and the arm pivot feature of the keeper lever is concurrently pivotally connected to the lever pivot anchor, the cam following feature of the keeper lever being operatively connected to the lever urging feature; and wherein rotation of the cam insert in a selected rotational direction causes rotation of the lever urging feature in the selected rotational direction, rotation of the lever urging feature responsively driving the cam following feature of the keeper lever to pivot the lever arm in the same rotational direction about the lever pivot anchor.

2. The tube bending apparatus of claim 1, wherein the bending wheel has an uninterrupted circular circumferential profile.

3. The tube bending apparatus of claim 1, wherein the tube-accepting recess has a "U"-shaped cross-section.

4. The tube bending apparatus of claim 1, wherein the tube-accepting recess extends entirely about a rounded outer circumference of the bending wheel.

5. The tube bending apparatus of claim 1, wherein the keeper finger extends longitudinally across at least a portion of the tube-accepting recess to at least partially cap the tube-accepting recess.

6. The tube bending apparatus of claim 5, wherein the keeper finger extends longitudinally distally past the tube-accepting recess to completely span the tube-accepting recess.

7. The tube bending apparatus of claim 1, wherein the camming flange is spaced longitudinally apart from the proximal wheel face by the keeper lever.

8. The tube bending apparatus of claim 1, wherein the keeper lever is longitudinally interposed between at least a portion of the camming flange and the proximal wheel face.

9. The tube bending apparatus of claim 1, including a snap ring for interaction with a ring groove in the shaft of the cam insert to retain the cam insert in pivotable relation to the bending wheel.

10. The tube bending apparatus of claim 9, including a countersink provided in the distal wheel face to prevent the snap ring from protruding distally beyond the distal wheel face.

11. A method of bending a tube, the method comprising:

providing a tube bending apparatus including a bending wheel including a circumferential tube-accepting recess and oppositely facing proximal and distal wheel faces, the bending wheel including a rotation recess extending longitudinally through the bending wheel between the proximal and distal wheel faces along a central axis of the bending wheel, and the proximal wheel face including a lever pivot anchor;

a cam insert including a longitudinally extending shaft having a tool driving feature extending coaxially at least partially therethrough, the shaft being configured for selective insertion into the rotation recess, the cam insert including a camming flange extending laterally from at least a portion of a proximal face of the shaft, the camming flange including a lever urging feature spaced laterally apart from the tool driving feature; and a keeper lever including a longitudinally extending keeper finger rigidly connected to an outboard end of a laterally extending lever arm, the keeper finger extending longitudinally from the proximal wheel face to at least a proximal-most portion of the tube-accepting recess, an anchor end of the lever arm including an arm pivot feature, the arm pivot feature being configured to pivotally connect to the lever pivot anchor, and the lever arm including a cam following feature spaced apart from the arm pivot feature, the cam following feature being configured to interact with the lever urging feature of the camming flange;

locating the shaft at least partially within the rotation recess to bring the camming flange in proximity to the proximal wheel face, and concurrently pivotally connecting the arm pivot feature of the keeper lever to the lever pivot anchor;

operatively connecting the cam following feature of the keeper lever to the lever urging feature;

placing the tube at least partially in the tube-accepting recess with a bending target portion of the tube, the bending target portion being spaced apart from at least one end of the tube, in a tangent relationship to the bending wheel;

driving rotation of the cam insert in a selected rotational direction to cause rotation of the lever urging feature in that the selected rotational direction;

with the lever urging feature, responsively driving the cam following feature of the keeper lever to pivot the lever arm in the selected rotational direction about the lever pivot anchor;

bringing the keeper finger proximate the tube-accepting recess through pivoting of the lever arm in the selected rotational direction about the lever pivot anchor;

maintaining a spatial position of the at least one end of the tube with respect to the tube bending apparatus;

rotating the tube bending apparatus in the selected rotational direction with the keeper finger held proximate the tube-accepting recess;

with the keeper finger, preventing egress of the tube from the tube-accepting recess; and at least partially wrapping the tube around the bending wheel to bend the tube due to a combination of differently-directed forces applied to the tube by the keeper finger and the maintained spatial position of the at least one end of the tube.

12. The method of claim 11, wherein the providing the tube bending apparatus includes providing the keeper finger extending longitudinally across at least a portion of the tube-accepting recess to at least partially cap the tube-accepting recess.

13. The method of claim 11, wherein the providing the tube bending apparatus includes providing the keeper finger extending longitudinally distally past the tube-accepting recess to completely span the tube-accepting recess.

14. The method of claim 11, wherein the providing the tube bending apparatus includes providing a snap ring for interaction with a ring groove in the shaft of the cam insert to retain the cam insert in pivotable relation to the bending wheel.

15. The method of claim 11, wherein the tool driving feature is a recess, and wherein the driving rotation of the cam insert in the selected rotational direction to cause rotation of the lever urging feature in the selected rotational direction includes placing a driving tool into operative relationship with the recess of the tool driving feature.

16. The method of claim 11, wherein the tool driving feature is a protrusion, and wherein the driving rotation of the cam insert in the selected rotational direction to cause rotation of the lever urging feature in the selected rotational direction includes placing a driving tool into operative relationship with the protrusion of the tool driving feature.

17. The method of claim 11, wherein the preventing egress of the tube from the tube-accepting recess includes pressing the keeper finger laterally against the tube as the tube bending apparatus turns, with a driving force being transmitted from the tool driving feature, through the operative connection between the lever urging feature and the cam following feature, and then to the keeper finger to press the tube laterally down into the tube-accepting recess.

18. The method of claim 11, including urging the keeper finger to exert clamping force on the tube in order to hold the tube within the tube-accepting recess, via rotation of the cam insert with respect to the bending wheel.

19. The method of claim 11, including removing the tube, having been bent, from the tube bending apparatus via at least one of sliding the tube bending apparatus over an end of the bent tube and reversing the rotation of the tube bending apparatus to release the bent tube from the keeper finger.

20. The method of claim 11, wherein both the preventing egress of the tube from the tube-accepting recess and the at least partially wrapping the tube around the bending wheel to bend the tube include imparting rotational force by a driving tool on the tube bending apparatus to serve both to urge the keeper finger laterally downward toward the tube-accepting recess as well as to impart a predetermined force upon the target bending portion of the tube to accomplish a predetermined bending function, without the keeper lever being operated separately by a user of the tube bending apparatus.

* * * * *